US005095596A

United States Patent [19]

Dahood

[11] Patent Number: 5,095,596

[45] Date of Patent: Mar. 17, 1992

[54] PENETRATING PERMANENT FABRIC MARKER

[76] Inventor: Michael K. Dahood, 14 Arnold Dr., Princeton Junction, N.J. 08550

[21] Appl. No.: 584,353

[22] Filed: Oct. 9, 1990

[51] Int. Cl.[5] ..... F16B 19/00; A44B 1/18

[52] U.S. Cl. ..... 24/704.1; 24/90 A; 24/90 C; 24/669; 24/DIG. 29

[58] Field of Search ..... 24/704.1, 703.1, 103, 24/104, DIG. 29, 90 A, 90 C; 40/669

[56] References Cited

U.S. PATENT DOCUMENTS

| | | | |
|---|---|---|---|
| 906,718 | 12/1908 | Kaufman | 40/669 |
| 1,030,883 | 7/1912 | Fuller | 40/669 |
| 1,198,567 | 9/1916 | Morley | 24/DIG. 29 |
| 1,239,070 | 9/1917 | Aldridge | 24/104 |
| 1,964,847 | 7/1934 | Engler et al. | 24/704.1 |
| 3,025,528 | 3/1962 | Minter | 24/703.1 |
| 3,041,743 | 7/1962 | Monsma | 24/DIG. 29 |
| 3,699,617 | 10/1972 | Hofmeister | 24/DIG. 29 |
| 4,682,389 | 7/1987 | Callender | 24/DIG. 29 |
| 4,813,110 | 3/1989 | Schiller | 24/104 |

FOREIGN PATENT DOCUMENTS

| | | | |
|---|---|---|---|
| 867888 | 5/1961 | United Kingdom | 24/108 |

*Primary Examiner*—Victor N. Sakran

[57] ABSTRACT

A rigid, penetrating fabric marker consisting of a piercing element and a locking cap. The piercing element consists of a barbed piercing post (14) and three short stabilizing posts (12A,12B,12C), all protruding at right angles from the plane of a flat, smooth, circular base (10). The locking cap consists of a pair of parallel locking elements (22A,22B) that span the concave interior of the hollow cap at the cap's center. The distance between the locking elements is equal to the diameter of the piercing post at its base. The space between the locking elements is penetrated by the piercing post and temporarily widened by the barbs (16A,16B) on the piercing post.

3 Claims, 1 Drawing Sheet

PENETRATING PERMANENT FABRIC MARKER

This invention relates to fabric-piercing fasteners, specifically to fasteners which are used to provide certain identification of the fabric to which they are attached for the life of the fabric.

Certain identification of articles of fabric and especially of apparel is desirable repeatedly over the useful life of the fabric. Most frequently the need for certain identification arises after washing of the fabric. This need is addressed in a commercial laundry by attaching various numbered legs. The need to identify individual items of apparel in a single family is also evident to anyone who has to sort a pile of clean laundry into smaller piles that belong to family members. In particular accurate identification is important for items such as socks that require pairing. All clothing that goes to summer camp theoretically requires identification.

The task of correctly sorting items of apparel is greatly facilitated by attaching an identifying tag to each item. Individual families have not had the volume necessary to justify the purchase of expensive automated equipment to mark apparel and have had to use indelible ink or tags that must be sewn, glued or ironed on. Such tags require sewing, gluing or ironing skills that impact the look of the finished product. Affixing the tags is time consuming and labor intensive. Even when affixed the tags do not differentiate among the apparel of different family members and do not help in the mating of socks.

Additionally, some people suffer from vision impairment. These people may be color blind, partially blind or completely blind. They are dependent on others not only for sorting their laundry but also for choosing outfits to wear and for determining that items are worn with the correct side facing out.

An invention, granted U.S. Pat. No. 1,030,883 on July 12, 1912, by Clarence Fuller was title "clothes-marking clip". This metal clip was designed to be attached by finger pressure. The clip would have one or more letters stamped on one side for identification. The clip could only be installed near an edge of fabric because it was designed to fold over on itself to achieve fastening. Other disadvantages include the possibility of metal fatigue resulting in failure, limited color, size, and texture variation and expense of stamping.

A tie marker was patented by James Minter (U.S. Pat. No. 3,025,528) on Mar. 20, 1962. However, the tie marker was intended to facilitate the tying of a tie, not identifying a tie. It also has the disadvantage of having to be located near an edge.

The present invention addresses the need to identify fabric articles with certainty. No special skills are required to achieve a permanent, color-fast and easily distinguishable identification. Several objects and advantages of the invention are:

(a) to provide a fabric piercing marker that can be located anywhere on a piece of fabric;

(b) to provide a marker that has a definite texture;

(c) to provide a marker that requires no special skills to affix;

(d) to provide a marker that allows quick and certain identification of apparel; and (e) to provide a marker that is inexpensive and not labor intensive to affix.

Other objects and advantages will become apparent from the following description and drawings depicting the invention.

Figure 1:
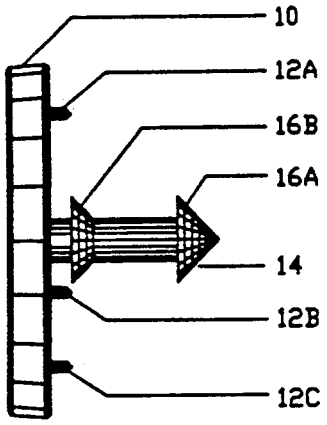
FIG. 1 is a side view of the piercing element.

The penetrating permanent fabric marker is a molded plastic device which in its preferred form consists of two pieces. The two pieces are (a) piercing element and (b) locking cap. The piercing element is depicted in FIG. 1. It consists of a flat circular base (labeled 10) from which three stabilizing posts (12A, 12B and 12C) protrude at equally spaced distances from each other, at right angles to the plane of the base and close the to the outer edge of the base. These posts are rigid, short, needlelike and capable of piercing both woven and non-woven fabrics. These posts help to keep the base from rotating in the fabric and reduce the likelihood of threads becoming wrapped around the piercing post (14). Protrusion from the center of the base in the same direction as the stabilizing posts is the maim piercing post (14). This piercing post is both thicker and longer than the stabilizing posts. Additionally, it has two barbs located at the end of the shaft farthest from the base (16A and 16B). These barbs are conical sections that project out from piercing post on its complete circumference. The piercing post is pointed to facilitate fabric penetration. The material comprising this piercing element will be able to withstand the extremes of heat and cold normal to wear and washing environments without becoming brittle. The piercing element will also be able to withstand reasonable lateral pressure to resist breaking of the piercing post and the stabilizing posts.

Figure 2:
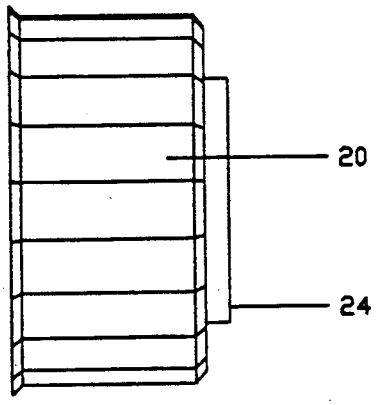
FIG. 2 is a side view of the locking cap.
Figure 3:
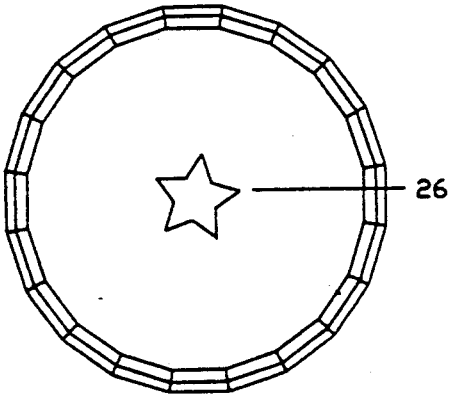
FIG. 3 is a top-down view of the locking cap.
Figure 4:
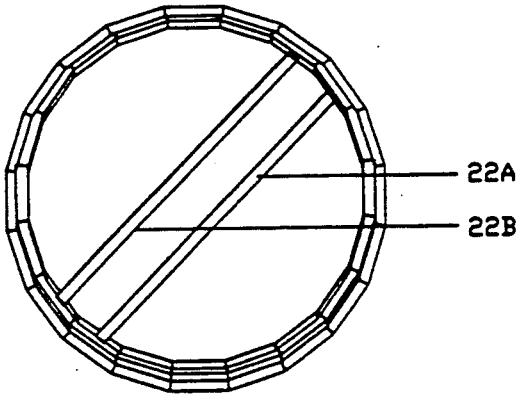
FIG. 4 is a bottom-up view of the locking cap.
Figure 5:
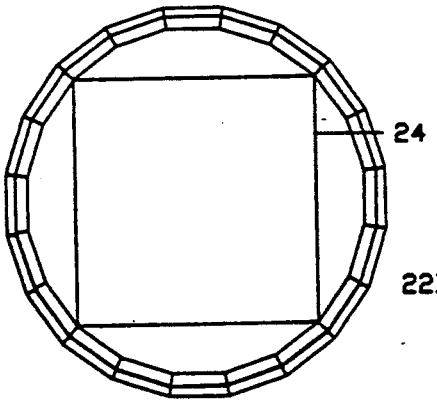
FIG. 5 is a top-down view of the locking cap with a different shape.
Figure 6:
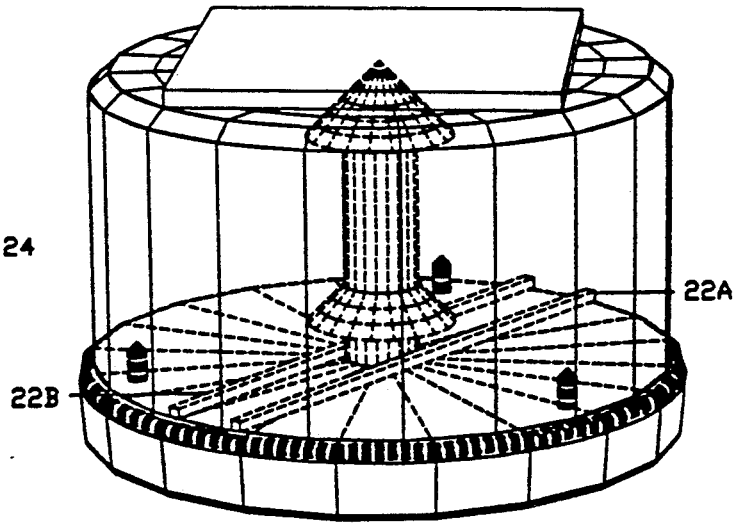
FIG. 6 is a perspective view of the two pieces of the marker.

FIG. 2 depicts the locking cap which will permanently lock onto the barbs of the piercing element after the fabric to be marked has been pierced. The locking cap will always be visible unless material is folded over it. The exterior of the locking cap (20) can be of any of an infinite number of shapes, patterns, textures, sizes and colors. Two of the possibilities are depicted in FIG. 3 and in FIG. 5. The shaped depicted in FIG. 3 and FIG. 5 are raised above the surface of the locking cap and can be identified by touch. The profile of a raised square (24, in FIG. 2) is shown in a top down view in FIG. 5. The shape of the locking cap can vary but it will always have a hollow interior deep enough to accommodate the piercing post and the stabilizing posts. FIG. 4 depicts the underside and interior of the locking cap. Two locking elements (22A and 22B) cross the interior of the cap parallel to each other and straddling the center of the cap. These elements will be pushed aside by the barbs of the piercing post as they pass through and will resume their pre-piercing distance from each other after the barb passes through them. This action will provide a permanent locking of the two elements. The two barbs are provided so that a tight fit can be achieved on very thin fabric and on thicker fabric, too. The distance between the two barbs in FIG. 1 is lengthened to emphasize the distinct position of the two barbs. The marker would work quite well with only one barb and a shorter shaft. A shorter shaft would also permit a shallower locking cap. FIG. 6 depicts both parts of the marker after permanent joining. A piece of material would be sandwiched between the two parts of the marker in actual use.

Other embodiments of the invention include an elongated piercing element with two piercing posts. In this embodiment the piercing element would be capped by an elongated cap with two sets of locking elements. In addition to providing a larger surface, this embodiment would allow for even greater variety of shape and strength would be enhanced. The stabilizing posts are not as important in this embodiment.

The manner in which the invention is used requires that a piece of fabric to be marked be held firmly enough that the piercing post can be forced through the weave of the fabric with simple thumb pressure. In some fabrics this may require stretching the fabric taut. Once pierced, the locking cap is pressed over the piercing post and the marker is secured. For marking a pair of socks: each sock is marked with an identical cap. Different pairs of socks should be marked with different sets of caps. Such marking establishes both certain identification of pairs and inside/outside of the marked socks. A marker inserted about one half inch from the top of the sock can be concealed by folding the top of the sock down over the marker. The base of the piercing element is thin and smooth with no sharp edges or angles. It may come into director contact with skin. It will mot be visible when the garment is worn correctly.

A visually impaired person could use the markers to identify coordinated clothing. In this use similar shaped markers might be affixed to a shirt, slacks/skirt, tie and socks all determined to form a desirable ensemble at the time of purchase or subsequently with the help of a fully sighted friend. In this use a visually impaired person could achieve a degree of independence in dressing. Additionally, the markers can be used to help vision impaired people determine if a garment is inside out.

Another use of the marker would be for summer camp. Camps frequently require name tags on all clothing. These tags require cutting and sewing or ironing or gluing to affix. This invention could eliminate this drudgery.

Still another use would be for institutions such as pre-schools or day-care centers that frequently "loan" clothing to children who have had accidents. Clothing marked with the school's logo would have a better chance of being returned.

The invention also has possible ;uses of a purely decorative nature. Since it can be situated anywhere on a garment and since it can have any design or material on its exposed cap it can be used to permanently affix an unlimited number of individual designs to any fabric garment.

The foregoing description of my invention details my favorite embodiment and mentions several different uses to which the invention is well suited. I envision the primary use of the invention in a residential rather than a commercial context. Retailers of socks may find that they can benefit by providing markers with their logos for each pair of socks sold. The invention is designed to be affixed using simple finger pressure but would lend itself to installation using some type of simple hand-held or table mounted affixing device in a residential or commercial location.

I claim:

1. A two-part penetrating marker for permanently identifying a fabric article to which said marker is affixed, comprised of a penetrating element consisting of a sturdy, centrally located, cylindrically shaped piercing post the point of which is a cone with a base whose diameter is wider than the diameter of the base of the piercing post and three small stabilizing posts, each tapered to a point, all of which protrude at a 90 degree angle to the plane of the base of the piercing element from which they emanate and from the same side of said base with the obverse side of the base being smooth, and a locking element consisting of a hollow cap with two parallel locking elements spaced the distance of diameter of the base of said piercing post, straddling the center of the hollow interior of the cap to which they are molded which are penetrated and spread apart by the cone point of said piercing post when said piercing post passes between said locking elements displacing said elements from their original parallel relationship until the base of the said cone of the piercing post passes beyond and between the said locking elements which locking elements then resume their original parallel relationship to each other, permanently locking onto and covering said penetrating post after said penetrating post has pierced a fabric article to be marked.

2. The construction defined in claim 1 in which the said hollow cap which contains said parallel locking elements on its interior side is adorned on its exterior surface with clearly distinguishable patterns, colors and shapes to facilitate certain identification by both visual and tactile means.

3. The construction defined in claim 1 requiring only normal finger pressure to achieve a permanent binding of the two parts of the marker.

* * * * *